US010837445B2

(12) United States Patent
Johnson

(10) Patent No.: US 10,837,445 B2
(45) Date of Patent: Nov. 17, 2020

(54) VARIABLE ECONOMIZER INJECTION POSITION

(71) Applicant: TRANE INTERNATIONAL INC., Davidson, NC (US)

(72) Inventor: Jay H. Johnson, Houston, MN (US)

(73) Assignee: TRANE INTERNATIONAL INC., Davidson, NC (US)

( * ) Notice: Subject to any disclaimer, the term of this patent is extended or adjusted under 35 U.S.C. 154(b) by 315 days.

(21) Appl. No.: 15/648,565

(22) Filed: Jul. 13, 2017

(65) Prior Publication Data

US 2018/0017059 A1 Jan. 18, 2018

Related U.S. Application Data

(60) Provisional application No. 62/361,817, filed on Jul. 13, 2016.

(51) Int. Cl.
*F25B 49/02* (2006.01)
*F04C 28/12* (2006.01)
(Continued)

(52) U.S. Cl.
CPC ..... *F04C 28/12* (2013.01); *F04C 18/107* (2013.01); *F04C 18/16* (2013.01); *F04C 29/12* (2013.01); *F25B 40/02* (2013.01); *F25B 49/022* (2013.01); *F04C 18/0207* (2013.01); *F04C 2240/30* (2013.01); *F04C 2270/215* (2013.01); *F25B 1/00* (2013.01); *F25B 1/047* (2013.01);
(Continued)

(58) Field of Classification Search
CPC ..... F04C 28/12
See application file for complete search history.

(56) References Cited

U.S. PATENT DOCUMENTS 3,408,826 A * 11/1968 Soumerai ..... F25B 1/047 62/193
4,180,986 A * 1/1980 Shaw ..... F04C 28/06 418/84
(Continued)

FOREIGN PATENT DOCUMENTS

CN 1245257 A 2/2000
CN 1246604 A 3/2000
(Continued)

OTHER PUBLICATIONS

Preliminary Search Report and Written Opinion, French Patent Application No. 1756710, dated Jun. 23, 2020, with English translation of Written Opinion (9 pages).

*Primary Examiner* — Frantz F Jules
*Assistant Examiner* — Alexis K Cox
(74) *Attorney, Agent, or Firm* — Hamre, Schumann, Mueller & Larson, P.C.

(57) ABSTRACT

A compressor includes a bore, a rotor disposed within the bore, a compressor inlet, a compressor outlet and a compression chamber defined between the bore and the rotor. A volume of the compression chamber gradually reduces from the compressor inlet to the compressor outlet. An economizer is configured to fluidically connect to the compression chamber. The economizer is configured to inject a working fluid into the compression chamber at an injection position. The injection position is changeable according to a working condition of the compressor.

10 Claims, 5 Drawing Sheets

(51) Int. Cl.

| | |
|---|---|
| ***F04C 18/107*** | (2006.01) |
| ***F04C 18/16*** | (2006.01) |
| ***F04C 29/12*** | (2006.01) |
| ***F25B 40/02*** | (2006.01) |
| *F25B 1/00* | (2006.01) |
| *F25B 31/00* | (2006.01) |
| *F25B 1/047* | (2006.01) |
| *F04C 18/02* | (2006.01) |

(52) U.S. Cl.
CPC ..... *F25B 31/006* (2013.01); *F25B 49/02* (2013.01); *F25B 2400/13* (2013.01); *F25B 2600/2507* (2013.01); *F25B 2600/2509* (2013.01)

(56) References Cited

U.S. PATENT DOCUMENTS

| | | | | |
|---|---|---|---|---|
| 4,383,802 | A * | 5/1983 | Gianni | F01M 11/12 417/12 |
| 5,018,948 | A | 5/1991 | Sjoeholm et al. | |
| 5,582,022 | A * | 12/1996 | Heinrichs | F25B 1/10 62/175 |
| 6,116,046 | A * | 9/2000 | Leaver | F04C 28/28 62/192 |
| 6,293,767 | B1 | 9/2001 | Bass | |
| 6,520,758 | B1 | 2/2003 | Sowards | |
| 7,770,376 | B1 * | 8/2010 | Brostmeyer | F01K 23/10 60/39.17 |
| 10,030,653 | B2 * | 7/2018 | Kienzle | F01C 20/10 |
| 2002/0038554 | A1 | 4/2002 | Monk et al. | |
| 2004/0184932 | A1 | 9/2004 | Lifson | |
| 2005/0247071 | A1 * | 11/2005 | Nemit, Jr. | F25B 41/04 62/197 |
| 2011/0256011 | A1 * | 10/2011 | Young | F04C 18/52 418/201.2 |
| 2013/0042640 | A1 * | 2/2013 | Higashiiue | F25B 41/00 62/196.1 |
| 2013/0177393 | A1 * | 7/2013 | Sishtla | F25B 1/10 415/1 |
| 2015/0275908 | A1 * | 10/2015 | Sishtla | F04D 29/462 415/1 |
| 2017/0211574 | A1 * | 7/2017 | Loerch | F04C 28/12 |
| 2019/0093657 | A1 * | 3/2019 | Joseph | F04C 18/16 |

FOREIGN PATENT DOCUMENTS

| | | | |
|---|---|---|---|
| CN | 1336987 | A | 2/2002 |
| CN | 1745251 | A | 3/2006 |
| CN | 1910341 | A | 2/2007 |
| CN | 101171464 | A | 4/2008 |
| CN | 101178065 | A | 5/2008 |
| CN | 101334029 | A | 12/2008 |
| CN | 101443609 | A | 5/2009 |
| CN | 101532496 | A | 9/2009 |
| CN | 105247217 | A | 1/2016 |
| EP | 2209968 | B1 | 1/2018 |
| WO | 2010/017384 | A2 | 2/2010 |

* cited by examiner

VARIABLE ECONOMIZER INJECTION POSITION

FIELD

This disclosure relates generally to a compressor. More specifically, the disclosure relates to a compressor in a fluid circuit, e.g., a refrigeration system or a heating, ventilating, and air conditioning (HVAC) system that includes an economizer, the compressor including an economizer injection position that is variable.

BACKGROUND

A refrigeration system or a heating, ventilating, and air conditioning (HVAC) system generally includes a compressor to compress a working fluid (e.g., refrigerant). The system generally includes a condenser disposed downstream of the compressor, an expansion device disposed downstream of the condenser, and an evaporator disposed downstream of the expansion device and upstream of the compressor.

SUMMARY

This disclosure relates generally to a compressor. More specifically, the disclosure relates to a compressor in a fluid circuit, e.g., a refrigeration system or a heating, ventilating, and air conditioning (HVAC) system that includes an economizer, the compressor including an economizer injection position that is variable.

An economizer can be used to increase an efficiency of an HVAC system. The benefit may result from enhancing a capacity of a compressor in the HVAC system by injecting subcooled vapor into a closed compressor pocket. This extra capacity benefit is obtained by using an incremental amount of compressor power to do the work of compression. The capacity benefit outweighs power consumption, resulting in a net efficiency increase for a compression cycle. In one embodiment, a fluid circuit may include an economizer delivering working fluid with intermediate pressure to a compressor. In one example, the economizer is receiving working fluid from a condenser or other component in the fluid circuit. The economizer may deliver working fluid to the compressor. The economizer may perform a heat exchanging process with the working fluid from the condenser or other components in the fluid circuit. In general, the working fluid exiting the economizer has an intermediate pressure. The intermediate pressure is between a compressor inlet pressure (e.g., a relatively lower pressure) and a compressor outlet pressure (e.g., a relatively higher pressure).

The economizer would normally inject the working fluid to a closed compression pocket within the compressor. This economizer injection pressure would match or be slightly higher than the pressure of the compressed working fluid in the closed compressor pocket at the injection position. However, the pressure of the compressor inlet is not constant. For example, the compressor can be unloaded (e.g., the capacity can be reduced) by moving a slide valve to effectively delay a start of compression. This can change the pressure profile along the length of the compression process. For a fixed position along the compression process, the pressure in a pocket can change when unloaded. At full load, for example, the pressure inside the first fully closed compression pocket can be a set pressure ratio above suction (e.g., at or about 1.1). The economizer circuit injects subcooled vapor into this pocket, incrementally increasing the capacity output of that pocket, thereby increasing system efficiency. When unloaded by a slide valve for example, this first fully closed pocket is opened to suction, delaying the start of compression. This effectively changes the pressure ratio above suction in that first compression pocket for example reducing the pressure ratio (e.g., to at or about 1.0). If the economizer location is set to be in this first closed pocket at full load, it can become ineffective when unloaded. This is because the economizer injects to suction pressure, negating the capacity increase benefit of the economizer.

The position of the injection port is usually set to a certain location so that the benefits the economizer are fully utilized when the compressor is at its full load (e.g., the pressure difference between the compressor outlet and the compressor inlet is at or close to its maximum).

However, in some situations as described above, the compressor is unloaded and the full benefits of the economizer are not utilized. In one example, the compressor can be unloaded because it is starting up. In another example, the compressor can be unloaded by design (e.g., using a slide valve to change the position of a compressor inlet, such as for example, along a moving path of a compressor chamber). If the pressure of the compression chamber is higher than the economizer at the economizer injection port, then working fluid flowing from the compression chamber may flow back to the economizer and the compressor can becomes less efficient. If the pressure of the compression chamber is lower than the economizer at the economizer injection port, then the economizer pressure drops and the benefits of using an economizer may be reduced.

To achieve the capacity increase benefit of the economizer, an economizer herein provides an injection location as described herein which moves along the compression path as the compressor is mechanically unloaded to remain within a closed pocket. Embodiments of this disclosure describe compressors that have a variable economizer injection position, such that, for example, the benefits of an economizer can be utilized even when a compressor is unloaded.

The phrase A is disposed "downstream of" B means a working fluid flows from B to A. The fluidic connection between A and B may be temporarily interrupted by other components in a refrigeration circuit (e.g., a flow regulating device).

The phrase A is disposed "upstream of B" means a working fluid flows from A to B. The fluidic connection between A and B may be temporarily interrupted by other components in a refrigeration circuit (e.g., a flow regulating device).

The phrases "unloading a compressor" or "a compressor is unloaded" mean a capacity of the compressor is decreasing or decreased from its possible maximum capacity. In one embodiment, if the compressor is fully loaded, the compressor is running at 100% capacity. In another embodiment, if the compressor is unloaded, the compressor may be running, for example, at 75%, 50%, or 25% of the maximum capacity.

The term "injection position" and/or "economizer injection position" means the position that the working fluid from the economizer is injected into the compressor (e.g., compression chamber).

The term "injection port" and/or "economizer injection port" means a space within the compressor where the economizer and the compressor chamber are fluidically connected.

The term "variable injection position" means that an "injection position" of an "injection port" is changeable within the compressor along a moving path of a compression chamber (e.g. from compressor inlet to compressor outlet). In one embodiment of a "variable injection position," the injection position of the injection port can be changed by selecting one or more suitable injection ports of a compressor disposed along a moving path of a compression chamber. For example, a compressor includes multiple injection ports. One or more flow regulating devices are used to select different injection ports to change the injection position. In another embodiment of a "variable injection position," the injection position of an injection port is changeable by physically moving the injection port along a moving path of the compression chamber of the compressor. For example, a compressor includes one injection port disposed on a movable member. The movable member (e.g., a slide valve) can move to change the position of the injection port.

In one embodiment, a compressor includes a bore, a rotor disposed within the bore, a compressor inlet, a compressor outlet, a compression chamber defined between the bore and the rotor, a volume of the compression chamber gradually reducing from the compressor inlet to the compressor outlet, and an injection port having a variable injection position.

In another embodiment, an economizer is fluidically connected to the injection port and the economizer injects a working fluid into the compression chamber through the injection port.

In one embodiment, a refrigeration circuit includes a compressor disposed upstream of a condenser. The condenser is disposed upstream of an expansion device. The expansion device is disposed upstream of an evaporator. The compressor further includes a bore, a rotor disposed within the bore, a compressor inlet, a compressor outlet, a compression chamber defined between the bore and the rotor, a volume of the compression chamber gradually reducing from the compressor inlet to the compressor outlet, and an injection port having a variable injection position. The compression chamber is fluidically connected to an economizer through the injection port.

In one embodiment, a method of varying the economizer injection position includes determining a working condition of a refrigeration circuit, controlling a flow regulating device to select an injection position, and injecting a working fluid from the economizer to the compressor at a suitable injection position.

BRIEF DESCRIPTION OF THE DRAWINGS

References are made to the accompanying drawings that form a part of this disclosure, and which illustrate embodiments in which the systems and methods described in this specification can be practiced.

Like reference numbers represent like parts throughout.

DETAILED DESCRIPTION

Figure 1:
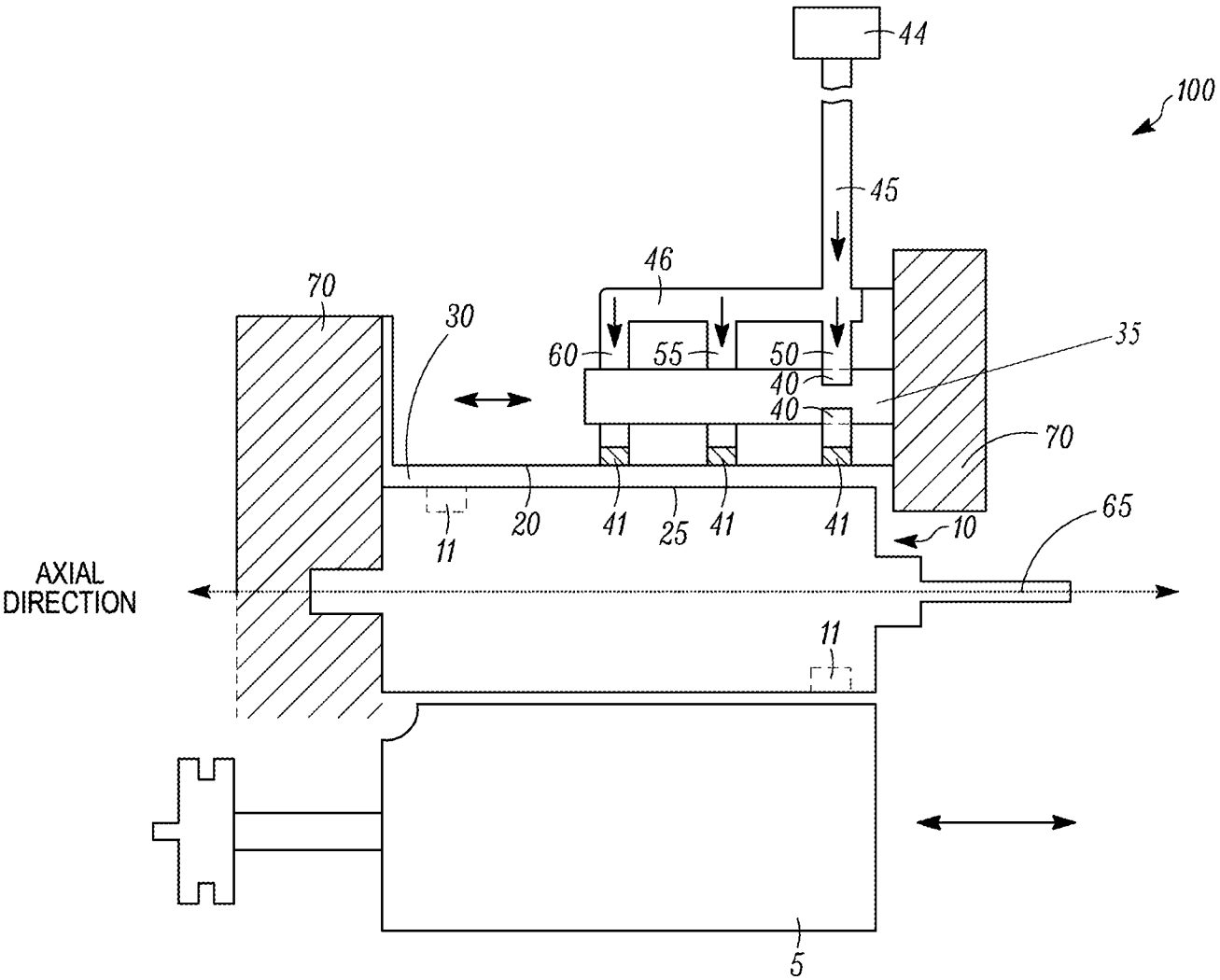
FIG. 1 illustrates an embodiment of a compressor with a variable economizer injection position using a manifold and a flow regulating device.

FIG. 1 illustrates an embodiment of a compressor 100 with a variable economizer injection position using a manifold 46 and a flow regulating device 35. In an embodiment, the flow regulating device 35 includes a valve, such as, but not limited to, a spool valve.

As shown in FIG. 1, the compressor 100 has a variable economizer injection position. The injection position can be changed by selecting different injection ports 41 with a flow regulating device 35 (e.g., a spool valve). The compressor 100 includes a bore 20 and a rotor 25 disposed within the bore 20. It will be appreciated that the compressor 100 may have two rotors 25 intermeshed, where the figures show a side view of the compressor showing one of the rotors 25. The compressor 100 includes a compressor inlet 10 and a compressor outlet 30 at the respective ends of the rotor(s) 25. The compressor 100 includes a compression chamber 11 defined between the bore 20 and the rotor 25, wherein a volume of the compression chamber 11 gradually reduces from the compressor inlet 10 to the compressor outlet 30. The rotor(s) 25 are supported by shaft(s) 65. The compressor 100 includes a housing 70 to house some or all of the components of the compressor 100.

The compressor 100 can be any type of compressor that compresses a working fluid. In one embodiment, as shown in FIG. 1, the compressor 100 is a positive displacement compressor. The relatively low pressure working fluid enters the compression chamber 11 at the compressor inlet 10. The compression chamber 11 moves along the rotor toward the compressor outlet 30 (e.g., from right to left with respect to the figure). While the compression chamber 11 moves from the compressor inlet 10 to the compressor outlet 30, the volume of the compressor chamber 11 reduces and the pressure of the working fluid in the compression chamber 11 increases, where the working fluid in the compression chamber 11 is being compressed. When the compression chamber 11 reaches the compressor outlet 30, the relatively high pressure working fluid exits the compression chamber 11 through the compressor outlet 30.

It is noted that the compressor 100 is not limited to the embodiment shown in FIG. 1. The compressor can be any type of compressor that compresses a working fluid. In one embodiment, the compressor 100 can be a screw compressor with at least one rotor. In another embodiment, the compressor 100 can be a scroll compressor.

As shown in FIG. 1, the compressor 100 is fluidically connected to an economizer 44. The economizer 44 is fluidically connected to the compression chamber 11. The economizer 44 is disposed upstream of a manifold 46. The manifold 46 is fluidically connected and disposed upstream of the compression chamber 11.

In an embodiment, the manifold 46 includes a manifold inlet 45 receiving working fluid from the economizer 44. In an embodiment, the manifold 46 includes a plurality of manifold outlets 50, 55, 60, for example as shown in FIG. 1, three manifold outlets are illustrated: the first 50, the second 55, and the third 60 manifold outlets. The working fluid exits the manifold 46 through the manifold outlets 50, 55, 60 to the compression chamber 11. Each manifold outlet 55, 55, 60 can be an injection port 41. It is noted that the number of manifold inlets and the number of manifold outlets are not limited. In one embodiment, the manifold 46 may have more than one manifold inlet. In another embodiment, the manifold 46 may have less than three manifold outlets. In yet another embodiment, the manifold 46 may have more than three manifold outlets.

The working fluid from the economizer 44 enters the compression chamber 11 at an injection port 41. Injection ports 41 connected to the manifold outlets 50, 55, 60 have different locations, e.g., different injection positions, along the bore 20 of the compressor 100 as shown in FIG. 1. By selecting different injection port 41 through a flow regulating device 35, the injection position can be changed. As shown in FIG. 1, the flow regulating device 35 can be a spool valve. As shown in the embodiment of FIG. 1, the flow regulating device 35 is movable such that one of the three manifold outlets 50, 55, 60 is selected to be the injection port 41.

As shown in FIG. 1, in one embodiment, the manifold outlet 50 is suitable to be selected by the flow regulating device 35 to provide the working fluid for economizer injection, when the compressor is running at 100% capacity for example. In another embodiment, the manifold outlet 55 is suitable to be selected by the flow regulating device 35 to provide the working fluid for economizer injection, when the compressor is running at 75% capacity for example. In another embodiment, the manifold outlet 60 is suitable to be selected by the flow regulating device 35 to provide the working fluid for economizer injection, when the compressor is running at 50% capacity for example.

The control logic for selecting different injection port 41 (e.g., changing the injection position) can be made according to a working condition of a refrigeration circuit. The refrigeration circuit may include a compressor, an economizer, a condenser, an expansion valve, and an evaporator fluidically connected. In one embodiment, the working condition of the refrigeration circuit can be a working condition of the compressor 100. In one embodiment, the working condition of the compressor 100 is the fluid pressure of the economizer 44. In another embodiment, the working condition of the compressor 100 is the fluid pressure of the compression chamber 11 at a specific location. In another embodiment, the working condition of the compressor 100 is to match the fluid pressure of the economizer 44 with the fluid pressure of the compression chamber 11. In yet another embodiment, the working condition is a pressure of the compressor inlet 10. In yet another embodiment, the working condition is a pressure of the compressor outlet 30 (or condenser pressure). In yet another embodiment, the working condition is a pressure difference between the compressor inlet 10 and the compressor outlet 30. In another embodiment, working condition could be the capacity output or load state of the compressor.

In one embodiment, the working condition of the refrigeration circuit can be a condenser temperature. In another embodiment, the working condition of the refrigeration circuit can be an evaporator temperature. In another embodiment, the working condition of the refrigeration circuit can be an economizer temperature. In another embodiment, the working condition of the refrigeration circuit can be a fan speed. In another embodiment, the working condition of the refrigeration circuit can be an energy consumption rate or capacity of a compressor.

As shown in FIG. 1, the flow regulating device 35 is disposed downstream of the manifold inlet 45 and upstream of the manifold outlets 50, 55, 60. In one embodiment, the flow regulating device 35 includes a manifold connecting channel 40 that fluidically connects the manifold inlet 45 and the one of the manifold outlets 50, 55, 60. In an embodiment, the flow regulating device 35 is movable in an axial direction such that the manifold connecting channel 40 aligns to one of the manifold outlets 50, 55, 60. By aligning the manifold connecting channel 40 with one of the manifold outlets 50, 55, 60, the working fluid can flow from the manifold inlet 45 through the flow regulating device 35, and to the manifold outlets 50, 55, 60, so that the particular injection port 41 is selected. By using the flow regulating device 35 and the manifold 46, the economizer injection position can be changed.

In one embodiment, a movement of the flow regulating device 35 can be actuated through a biasing member (e.g., a spring). In another embodiment, a movement of the flow regulating device 35 can be actuated through a fluid pressure (e.g., a gas pressure, a liquid pressure, etc.). In another embodiment, a movement of the flow regulating device 35 can be actuated through a motor. In one embodiment, a movement of the flow regulating device 35 may be controlled by a controller which has one or more signal input/output interfaces and executes computer readable instructions. In one embodiment, a controller may control a movement of the flow regulating device 35 based on one or more detected working conditions of the compressor 100 as an input signal. In an embodiment, the flow regulating device 35 can be controlled passively by a biasing mechanism, pressure, or combination of both.

As the slide valve 5 moves, the pressure of the compression chamber 11 may change at a certain position of the rotor (e.g., the compressor can be unloaded and the capacity is changed). In this case, the flow regulating device 35 may move to select a suitable manifold outlet 50, 55, 60 such that the pressure of the economizer 44 matches the pressure of the compression chamber 11 to maximize the efficiency of the compressor 100 and better utilize the benefits of the economizer 44.

Figure 2:
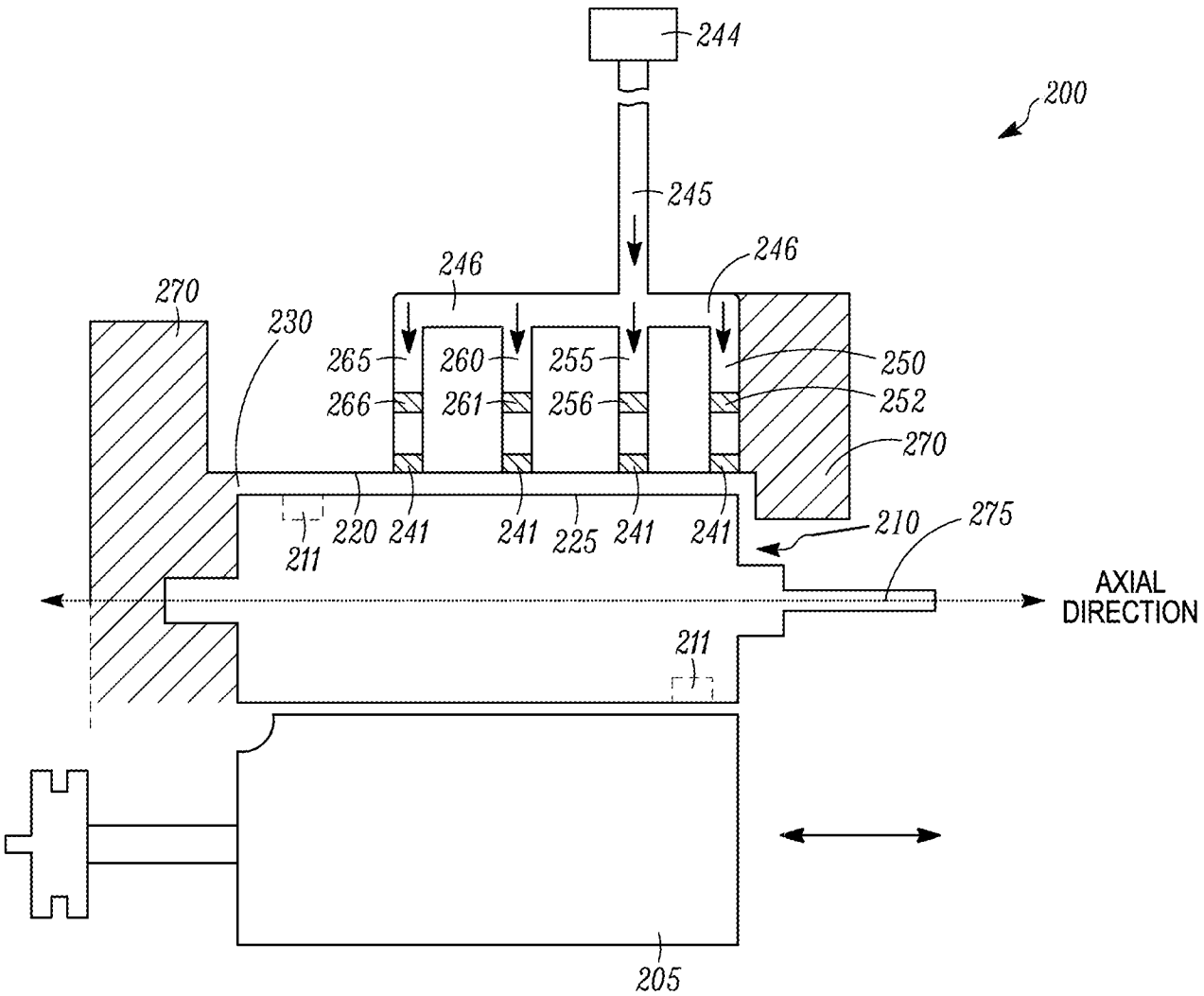
FIG. 2 illustrates an embodiment of a compressor with injection ports having variable economizer injection positions using a manifold and a plurality of flow regulating devices.

FIG. 2 illustrates an embodiment of a compressor 200 with injection ports 241 having variable economizer injection positions using a manifold 246 and a plurality of flow regulating devices 252, 256, 261, 266.

Similar to compressor 100 in FIG. 1, the compressor 200 in FIG. 2 includes a bore 220 and a rotor 225 disposed within the bore 220. It will be appreciated that the compressor 200 may have two rotors 225 intermeshed, where the figures show a side view of the compressor showing one of the rotors 225. The compressor 100 includes a compressor inlet 210 and a compressor outlet 230 at the respective ends of the rotors 225. The compressor 200 includes a compression chamber 211 defined between the bore 220 and the rotor 225, wherein a volume of the compression chamber 211 gradually reduces from the compressor inlet 210 to the compressor outlet 230. The rotor(s) 225 are supported by shaft(s) 275. The compressor 200 includes a housing 270 to house some or all of the components of the compressor 200.

The compressor 200 can be any type of compressor that compresses a working fluid. In one embodiment, as shown in FIG. 2, the compressor 200 is a positive displacement compressor. The relatively low pressure working fluid enters the compression chamber 211 at the compressor inlet 210. The compression chamber 211 moves along the rotor 225 toward the compressor outlet 230. While the compression chamber 211 moves from the compressor inlet 210 to the compressor outlet 230, the volume of the compression chamber 211 reduces and the pressure of the working fluid in the compression chamber 211 increases, where the working fluid in the compression chamber 211 is being compressed. When the compression chamber 211 reaches the compressor outlet 230, the relatively high pressure working fluid exits the compression chamber 211 through the compressor outlet 230.

It is noted that the compressor 200 is not limited to the embodiment shown in FIG. 2. The compressor 200 can be any type of compressor that compresses a working fluid. In one embodiment, the compressor 200 can be a screw compressor with at least one rotor. In another embodiment, the compressor 200 can be a scroll compressor.

As shown in FIG. 2, the compressor 200 is fluidically connected to the economizer 244. The economizer 244 is fluidically connected to the compression chamber 211. The economizer 244 is disposed upstream of the manifold 246. The manifold 246 is fluidically connected to and disposed upstream of the compression chamber 211.

In an embodiment, the manifold 246 includes a manifold inlet 245 receiving working fluid from the economizer 244. In an embodiment, the manifold 246 includes four manifold outlets 250, 255, 260, 265: the first 250, the second 255, the third 260, and the fourth 265 manifold outlets. The working fluid exits the manifold 246 through the manifold outlets 250, 255, 260, 265 to the compression chamber 211. Each manifold outlet 250, 255, 260, 265 can be an injection port 241. It is noted that the number of manifold inlets 245 and the number of manifold outlets 250, 255, 260, 265 are not limited. In one embodiment, the manifold 246 may have more than one manifold inlet 245. In another embodiment, the manifold 246 may have less than four manifold outlets 250, 255, 260, 265. In yet another embodiment, the manifold 246 may have more than four manifold outlets 250, 255, 260, 265.

The working fluid from the economizer 244 enters the compression chamber 211 at an injection port 241. Injection ports 241 connected to the manifold outlets 250, 255, 260, 265 have different locations (e.g., different injection positions) along the bore 220 of the compressor 200, as shown in FIG. 2. By selecting a different injection port 241 through a plurality of flow regulating devices 252, 256, 261, 266, the injection position can be changed. In one embodiment, the flow regulating devices 252, 256, 261, 266 can be solenoid valves. It will be appreciated that the flow regulating devices may be any suitable valve, including for example a poppet valve. As shown in FIG. 2, the compressor 200 includes first 252, second 256, third 261, and fourth 266 flow regulating devices disposed in the first 250, the second 255, the third 260, and the fourth 265 manifold outlets, respectively. Each flow regulating device 252, 256, 261, 266 can be controlled independently. In one embodiment, the flow regulating devices 252, 256, 261, 266 are controlled such that one regulating device 252, 256, 261, 266 is open at a time.

As shown in FIG. 2, in one embodiment, the manifold outlet 250 is suitable to be selected by the flow regulating device 252 (e.g., a solenoid valve or poppet valve) to provide the working fluid for economizer injection, when the compressor 200 is running at 100% capacity for example. In another embodiment, the manifold outlet 255 is suitable to be selected by the flow regulating device 256 (e.g., a solenoid valve or poppet valve) to provide the working fluid for economizer injection, when the compressor 200 is running at 75% capacity for example. In another embodiment, the manifold outlet 260 is suitable to be selected by the flow regulating device 261 (e.g., a solenoid valve or a poppet valve) to provide the working fluid for economizer injection, when the compressor 200 is running at 50% capacity for example. In another embodiment, the manifold outlet 265 is suitable to be selected by the flow regulating device 266 (e.g., a solenoid valve or poppet valve) to provide the working fluid for economizer injection, when the compressor 200 is running at 25% capacity for example.

The control logic for selecting which regulating device 252, 256, 261, 266 to open (i.e. changing the injection position) can be made according to a working condition of the compressor 200. In one embodiment, the working condition of the compressor 200 is the fluid pressure of the economizer 244. In another embodiment, the working condition of the compressor 200 is the fluid pressure of the compression chamber 211 at a specific location. In another embodiment, the working condition of the compressor 200 is to match the fluid pressure of the economizer 244 with the fluid pressure of the compression chamber 211. In yet another embodiment, the working condition is a pressure of the compressor inlet 210. In yet another embodiment, the working condition is a pressure of the compressor outlet 230 (or condenser pressure). In yet another embodiment, the working condition is a pressure difference between the compressor inlet 210 and the compressor outlet 230. In another embodiment, working condition could be the capacity output or load state of the compressor 200.

In another embodiment, the working condition of the compressor 200 can be a condenser temperature. In another embodiment, the working condition of the compressor 200 can be an evaporator temperature. In another embodiment, the working condition of the compressor 200 can be an economizer temperature. In another embodiment, the working condition of the compressor 200 can be a fan speed. In another embodiment, the working condition of the compressor 200 can be an energy consumption rate or capacity of the compressor 200.

As shown in FIG. 2, the compressor 200 includes a slide valve 205. The slide valve 205 includes the compressor inlet 210. The slide valve 205 is movable in an axial direction. When the slide valve 205 moves, the compressor inlet 210 moves along the rotor 225 in an axial direction (e.g., left-right in the figure). In general, when the compressor inlet 210 is moved closer to the compressor outlet 230 in the axial direction, the pressure difference between the compressor outlet 230 and the compressor inlet 210 can become smaller, where the compressor 200 is unloaded and the capacity reduced. On the other hand, in general, when the compressor inlet 210 is moved away from the compressor outlet 230 in the axial direction, the pressure difference between the compressor outlet 230 and the compressor inlet 210 can become larger, where the compressor capacity is increased. Therefore, capacity of the compressor 200 can be regulated by a movement of the slide valve 205.

As the slide valve 205 moves, the pressure of the compression chamber 211 may change at a certain position of the rotor (e.g., the compressor 200 is unloaded). In this case, one of the flow regulating devices 252, 256, 261, 266 may be controlled to open (the remaining three flow control devices are closed) to select one injection port 214 (e.g., selecting an injection position) such that the pressure of the economizer 244 matches the pressure of the compression chamber 211 to maximize the efficiency of the compressor and better utilize the benefits of the economizer 244.

Figure 3:
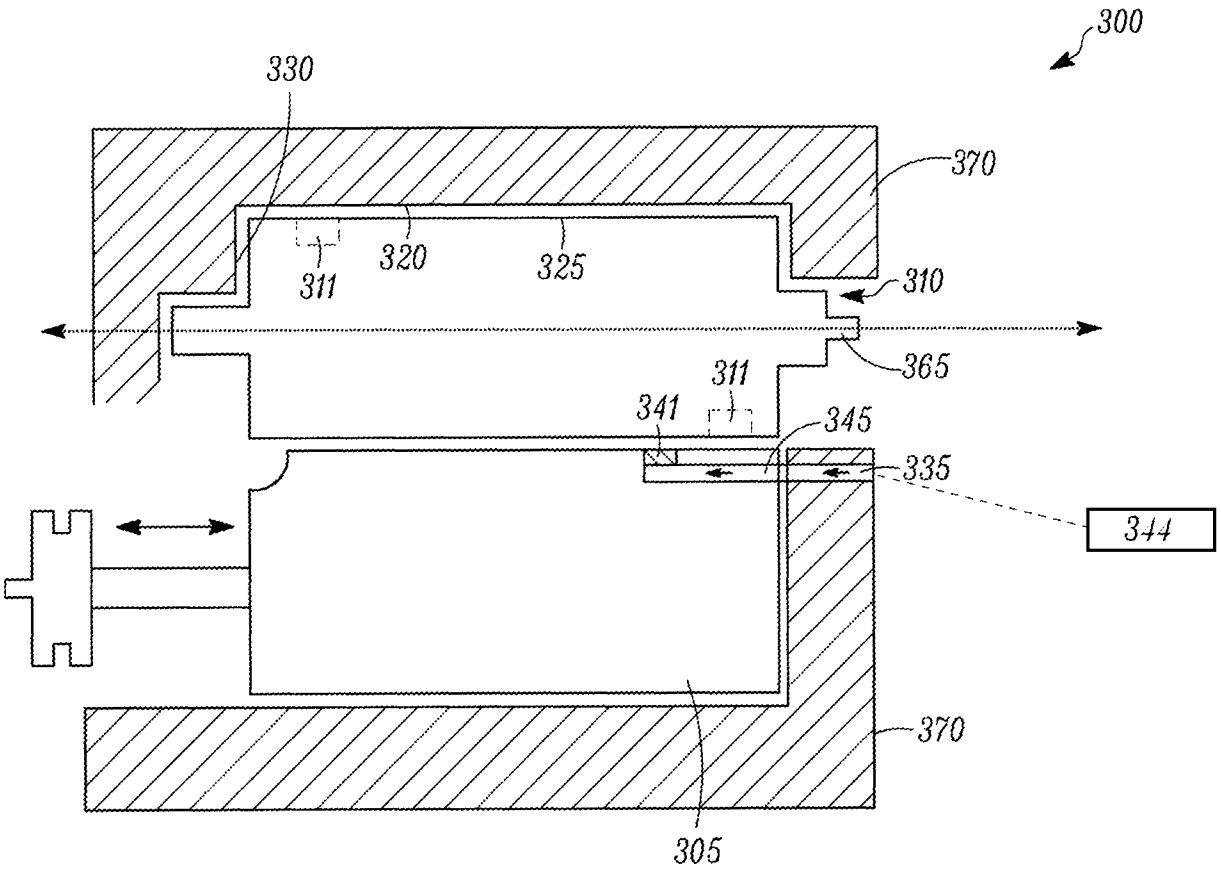
FIG. 3 illustrates an embodiment of a compressor with a variable economizer injection position using a slide valve with a fluid delivering channel embedded within the slide valve.

FIG. 3 illustrates an embodiment of a compressor 300 with a variable economizer injection position 341 using a slide valve 305. A fluid delivering channel 335 is embedded within the slide valve 305. In an embodiment, the slide valve 305 includes a channel 345. In an embodiment, the channel 345 is on a side of the slide valve 305, for example on a bottom of the slide valve 305. In an embodiment, the channel 345 is a horizontally oriented channel. In an embodiment, the fluid delivering channel 335 enters a compressing housing 370 and is fluidically connected with the channel 345 of the slide valve 305, and where the channel 345 is fluidically connected with the rotor injection pocket (e.g., 341 with 311).

As shown in FIG. 3, the compressor 300 has a variable economizer injection position 341 wherein the injection position can be changed. The compressor 300 can be any type of compressor that compresses a working fluid. In one embodiment, the compressor 300 includes a bore 320 and a rotor 325 disposed within the bore 320. It will be appreciated that the compressor 300 may have two rotors 325 intermeshed, where the figures show a side view of the compressor showing one of the rotors 325. The compressor 300 includes a compressor inlet 310 and a compressor outlet 330 at respective ends of the rotors 325. The compressor 300 includes a compression chamber 311 defined between the bore 320 and the rotor 325, wherein a volume of the compression chamber 311 gradually reduces from the compressor inlet 310 to the compressor outlet 330. The rotor(s) 325 are supported by shaft(s) 365. The compressor 300 includes a housing 370 to house some or all of the components of a compressor 300.

In one embodiment, as shown in FIG. 3, the compressor 300 is a positive displacement compressor. The relatively low pressure working fluid enters the compression chamber 311 at the compressor inlet 310. The compression chamber 311 moves along the rotor 325 toward the compressor outlet 330. While the compression chamber 311 moves from the compressor inlet 310 to the compressor outlet 330, the volume of the compressor chamber 311 reduces and the pressure of the working fluid in the compression chamber 311 increases, where the working fluid in the compression chamber 311 is being compressed. When the compression chamber 311 reaches the compressor outlet 330, the relatively high pressure working fluid exits the compression chamber 311 through the compressor outlet 330.

It is noted that the compressor 300 is not limited to the embodiment shown in FIG. 3. The compressor can be any type of compressor that compresses a working fluid. In one embodiment, the compressor 300 can be a screw compressor with at least one rotor. In another embodiment, the compressor 300 can be a scroll compressor.

As shown in FIG. 3, the compressor 300 is fluidically connected to an economizer 344. The economizer 344 is fluidically connected to the compression chamber 311. The economizer 344 is disposed upstream of the fluid delivering channel 335. The fluid delivering channel 335 is disposed upstream of channel 345 of the slide valve 305 which is upstream of the injection port 341. The injection port 341 is fluidically connected to the compression chamber 311.

As shown in FIG. 3, the compressor 300 includes a slide valve 305. The slide valve 305 includes the compressor inlet 310. The slide valve 305 also includes the channel 345 in fluid communication with the fluid delivering channel 335. The fluid delivering channel 335 connects the economizer 344 and the compression chamber 311 through the channel 345 and injection port 341. The slide valve 305 is movable in an axial direction.

When the slide valve 305 moves, the compressor inlet 310 moves along the rotor 325 in an axial direction (e.g., left-right in the figure). Moreover, when the slide valve 305 moves, the injection port 341 also moves along the rotor 325 in the axial direction. As shown in FIG. 3, the injection port 341, in one embodiment, maintains a constant distance with the compressor inlet 310. In general, when the injection port 341 moves closer to the compressor outlet 330 in the axial direction, the pressure difference between the compressor outlet 330 and the compressor inlet 310 can become smaller, where the capacity is reduced by unloading the compressor 300. On the other hand, in general, when the injection port 341 moves away from the compressor outlet 330 in an axial direction, the pressure difference between the compressor outlet 330 and the compressor inlet 310 can become larger, where the capacity of the compressor 300 is increased (e.g., loading the compressor). The capacity of the compressor 300 can be regulated by a movement of the slide valve 305.

In the embodiment shown in FIG. 3, the relative distance between the injection port 341 and the compressor inlet 310 is constant. In one embodiment, the relative distance between the injection port 341 and the compressor inlet 310 is short, so that the pressure of the economizer 344 generally matches the pressure of the compressor inlet 310. The design of the embodiment shown in FIG. 3 can further simplify the variable economizer injection position 341.

Figure 4:
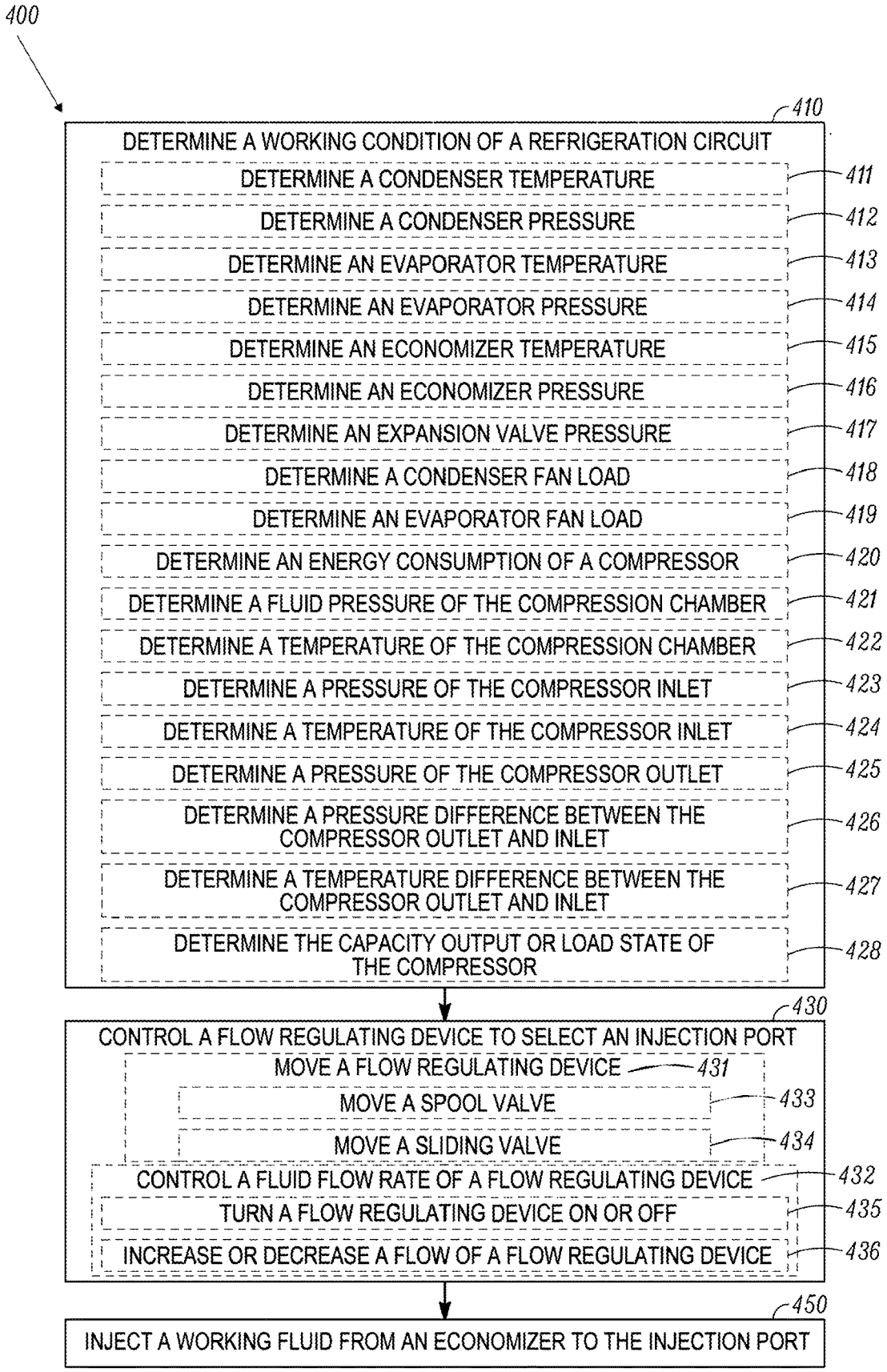
FIG. 4 shows an embodiment of a method of varying the economizer injection position.

FIG. 4 shows an embodiment of a method 400 to vary the economizer injection position. The method 400 of varying the economizer injection position can be applied to any compressor that has a variable economizer injection position (e.g., the embodiments shown in FIGS. 1-3 and 5).

The method 400 of varying the economizer injection position includes determining a working condition of a refrigeration circuit 410, wherein the refrigeration circuit may include a compressor, an economizer, a condenser, an expansion valve, an evaporator, a condenser fan, an evaporator fan. The method 400 of varying the economizer injection position further includes controlling a flow regulating device to select an injection port 430, and injecting a working fluid from an economizer to the compressor at a suitable injection port 450.

Determining the working condition of the refrigeration circuit 410 may further include determining a condenser temperature 411, determining a condenser pressure 412, determining an evaporator temperature 413, determining an evaporator pressure 414, determining an economizer temperature 415, determining an economizer pressure 416, determining an expansion valve pressure 417, determining a condenser fan load 418, determining an evaporator fan load 419, determining an energy consumption of a compressor 420, determining a fluid pressure of the compression chamber 421, determining a temperature of the compression chamber 422, determining a pressure of the compressor inlet 423, determining a temperature of the compressor inlet 424, determining a pressure of the compressor outlet 425, determining a pressure difference between the compressor outlet and inlet 426, and/or determining a temperature difference between the compressor outlet and inlet 427. In an embodiment, determining the working condition could be determining the capacity output or load state of the compressor 428.

Controlling the flow regulating device to select an injection port 430 may further include moving a flow regulating device 431, and/or controlling a fluid flow rate of a flow regulating device 432. The step of moving a flow regulating device 431 may further include moving a valve, such as for example a spool valve 433 and/or moving a slide valve 434. The step of controlling a fluid flow rate of a flow regulating device 432 may further include turning a flow regulating device on or off 435 and/or increasing or decreasing a flow of a flow regulating device 436.

Figure 5:
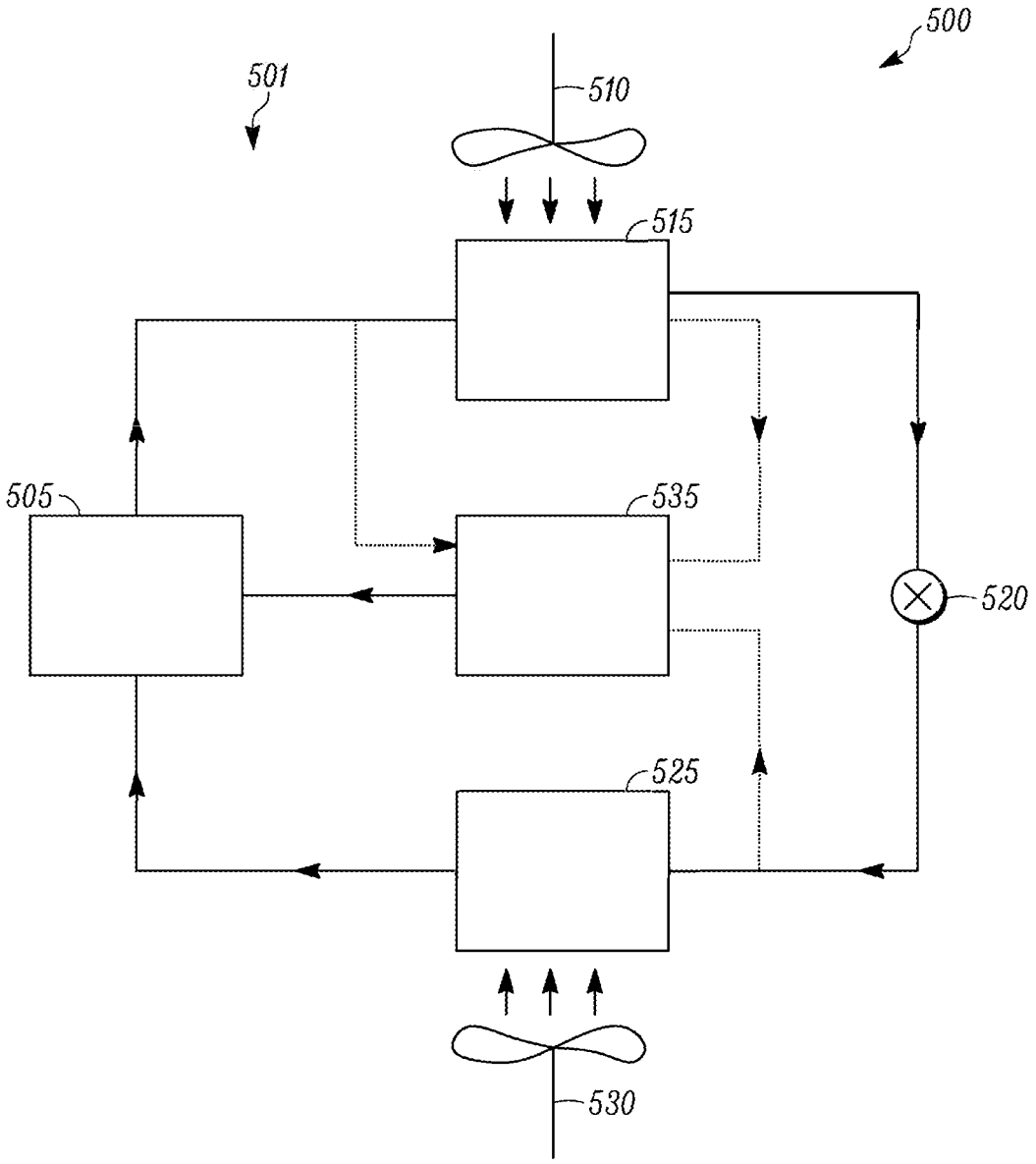
FIG. 5 shows an embodiment of a refrigeration circuit.

FIG. 5 shows an embodiment of a refrigeration circuit 500. The refrigeration circuit 500 may include any compressor that has a varying economizer injection position (e.g., the compressors shown in FIGS. 1-3). The refrigeration circuit 500 may be used in any method of varying the economizer injection position (e.g., the method 400 shown in FIG. 4).

The refrigeration circuit 500 includes a fluid circuit 501. The elements in the fluid circuit are fluidically connected. The fluid circuit 501 includes a compressor 505, a condenser 515, an expansion device 520, an evaporator 525, and an economizer 535.

The condenser 510 is disposed downstream of the compressor 505. The expansion device 520 is disposed downstream of the condenser 515. The evaporator 525 is disposed downstream of the expansion device 520. The compressor 505 is disposed downstream of the evaporator 525.

In one embodiment, the economizer 535 is disposed fluidically connected to the compressor 505. In one embodiment, the economizer 535 may be fluidically connected to the compressor 505, injecting working fluid into the compressor 505. In one embodiment, the economizer 535 may be fluidically connected to the condenser 515, receiving working fluid downstream or upstream of the condenser 515. In one embodiment, the economizer 535 may be fluidically connected downstream of the expansion device 520, receiving working fluid from the expansion device 520. It will be appreciated that the working fluid may be sourced from the components of the refrigerant circuit 500 lines to/from such components, and/or combinations thereof.

In an embodiment, the refrigeration circuit 500 includes a condenser fan 510. The condenser fan 510 blows air to the condenser 510 to enhance the heat-exchanging process. It will be appreciated that a condenser fan may be employed in air cooled systems (e.g. air cooled chillers). It will be appreciated that a condenser fan may not be employed for example in a water-cooled system (e.g. water cooled chillers).

In an embodiment, the refrigeration circuit 500 includes an evaporator fan 530. It will be appreciated that an evaporator fan may be employed in unitary products type of systems. It will be appreciated that an evaporator fan may not be employed for example (e.g. in fluid or water chillers). The evaporator fan 530 blows air to the evaporator 525 to enhance the heat-exchanging process. In an embodiment, chillers would use a water pump and not an evaporator fan for the heat exchanging process.

It is noted that any of aspects 1-12 can be combined with any of aspects 13-26. Further, any of aspects 13-20 can be combined with any of aspects 21-26.

Aspect 1. A compressor, comprising a bore, a rotor disposed within the bore, a compressor inlet, a compressor outlet, a compression chamber defined between the bore and the rotor, wherein a volume of the compression chamber gradually reduces from the compressor inlet to the compressor outlet, and an injection port having a variable injection position.

Aspect 2. The compressor according to aspect 1, wherein an economizer is fluidically connected to the injection port, the economizer injects a working fluid into the compression chamber through the injection port.

Aspect 3. The compressor according to any one of aspects 1-2, further comprising a manifold fluidically connecting the economizer and the compression chamber, the manifold further including, a manifold inlet disposed downstream of the economizer, two or more manifold outlets disposed downstream of the manifold inlet, the manifold outlets disposed upstream of the compression chamber, wherein, the manifold forms the injection port having a variable injection position.

Aspect 4. The compressor according to any one of aspects 1-2, further comprising a manifold fluidically connecting the economizer and the compression chamber, the manifold further including, a manifold inlet disposed downstream of the economizer, a plurality of manifold outlets disposed downstream of the manifold inlet, the manifold outlets disposed upstream of the compression chamber, wherein each manifold outlet is disposed at a different location along a moving path of the compression chamber, a valve disposed downstream of the manifold inlet and upstream of the manifold outlets, wherein the valve is configured to be movable such that only one manifold outlet is fluidically connected to the manifold inlet allowing the injection position to be changed.

Aspect 5. The compressor according to aspect 4, wherein the valve is moved by a spring or a fluid pressure.

Aspect 6. The compressor according to aspect 4, wherein the valve is moved by a motor.

Aspect 7. The compressor according to any one of aspects 1-2, further comprising a slide valve, wherein the compressor inlet is disposed on the slide valve, the slide valve is configured to be movable.

Aspect 8. The compressor according to aspect 7, wherein the output capacity of the compressor is regulated by a movement of the slide valve such that the compressor is unloadable.

Aspect 9. The compressor according to any one of aspects 7-8, wherein the slide valve is moved by a motor, a spring, or a fluid pressure.

Aspect 10. The compressor according to any one of aspects 1-9, wherein the variable injection position of the injection port is changed based on a working condition of the compressor.

Aspect 11. The compressor according to aspect 10, wherein the working condition is a pressure of the compressor inlet or a pressure of the compressor outlet.

Aspect 12. The compressor according to aspect 10, wherein the working condition is a pressure difference between the compressor outlet and the compressor inlet.

Aspect 13. A refrigeration circuit, comprising a compressor disposed upstream of a condenser, the condenser disposed upstream of an expansion device, the expansion device disposed upstream of an evaporator, and the compressor further including:

a bore, a rotor disposed within the bore, a compressor inlet, a compressor outlet, a compression chamber defined between the bore and the rotor, wherein a volume of the compression chamber gradually reduces from the compressor inlet to the compressor outlet, and an injection port having a variable injection position, wherein the compression chamber is fluidically connected to an economizer through the injection port.

Aspect 14. The refrigeration circuit according to aspect 13, wherein an economizer is fluidically connected to the injection port, the economizer inject a working fluid into the compression chamber through the injection port.

Aspect 15. The refrigeration circuit according to any one of aspects 13-14, further comprising a manifold fluidically connecting the economizer and the compression chamber, the manifold further including, a manifold inlet disposed downstream of the economizer, two or more manifold outlets disposed downstream of the manifold inlet, the manifold outlets disposed upstream of the compression chamber, wherein, the manifold forms the injection port having a variable injection position.

Aspect 16. The refrigeration circuit according to any one of aspects 13-14, further comprising a manifold fluidically connecting the economizer and the compression chamber, the manifold further including, a manifold inlet disposed downstream of the economizer, a plurality of manifold outlets disposed downstream of the manifold inlet, the manifold outlets disposed upstream of the compression chamber, wherein each manifold outlet is disposed at a different location along a moving path of the compression chamber, a valve disposed downstream of the manifold inlet and upstream of the manifold outlets, wherein the valve is configured to be movable such that only one manifold outlet is fluidically connected to the manifold inlet allowing the injection position to be changed.

Aspect 17. The refrigeration circuit according to aspect 16, wherein the valve is moved by a spring or a fluid pressure.

Aspect 18. The refrigeration circuit according to aspect 16, wherein the valve is moved by a motor.

Aspect 19. The refrigeration circuit according to any one of aspects 13-14, further comprising a slide valve, wherein the compressor inlet is disposed on the slide valve, the slide valve is configured to be movable.

Aspect 20. The refrigeration circuit according to aspect 19, wherein the output capacity of the compressor regulated by a movement of the slide valve such that the compressor is unloadable.

Aspect 21. The refrigeration circuit according to any one of aspects 19-20, wherein the slide valve is moved by a motor, a spring, or a fluid pressure.

Aspect 22. The refrigeration circuit according to any one of aspects 19-20, wherein the variable injection position of the injection port is changed based on a working condition of the compressor.

Aspect 23. The compressor according to aspect 22, wherein the working condition is a pressure of the compressor inlet or a pressure of the compressor outlet.

Aspect 24. The compressor according to aspect 22, wherein the working condition is a pressure difference between the compressor outlet and the compressor inlet.

Aspect 25. A method of varying the economizer injection position, including determining a working condition of a refrigeration circuit, controlling a flow regulating device to select an injection port, and injecting a working fluid from the economizer to the compressor at a suitable injection port.

Aspect 26. The method according to aspect 25, wherein the step of determining the working condition of a refrigeration circuit includes at least one selected from determining a condenser temperature, determining a condenser pressure, determining an evaporator temperature, determining an evaporator pressure, determining an economizer temperature, determining an evaporator pressure, determining an expansion valve pressure, determining a condenser fan load, determining an evaporator fan load, determining an energy consumption of a compressor, determining a fluid pressure of the compression chamber, determining a temperature of the compression chamber, determining a pressure of the compressor inlet, determining a temperature of the compressor inlet, determining a pressure of the compressor outlet, determining a capacity output or unloaded state determining a temperature difference between the compressor outlet and inlet.

Aspect 27. The method according to any of aspects 25-26, wherein the step of controlling the flow regulating device to select an injection port includes at least one selected from the followings, moving a flow regulating device, and controlling a fluid flow rate of a flow regulating device.

Aspect 28. The method according to aspect 27, wherein the step of moving the flow regulating device includes at least one selected form the followings: moving a valve, and moving a slide valve.

Aspect 29. The method according to aspect 27, wherein the step of controlling a fluid flow rate of a flow regulating device includes at least one selected from the followings: turning a flow regulating device on or off, and increasing or decreasing a flow of a flow regulating device.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, specify the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A compressor, comprising a bore, a rotor disposed within the bore, a shaft supporting the rotor, the shaft extending in an axial direction, a compressor inlet, a compressor outlet, a compression chamber defined between the bore and the rotor, an injection port having a variable injection position along the axial direction, a manifold fluidically connecting an economizer and the compression chamber, the manifold further including:

a manifold inlet, a plurality of manifold outlets disposed downstream of the manifold inlet, the manifold outlets disposed upstream of the compression chamber, wherein each manifold outlet is disposed at a different location along the axial direction, a valve disposed downstream of the manifold inlet and upstream of the manifold outlets, wherein the valve is configured to be movable along the axial direction such that only one manifold outlet is fluidically connected to the manifold inlet allowing the injection position to be changed.

2. The compressor according to claim 1, wherein the injection port is configured to fluidically connect to the economizer to receive a working fluid from the economizer to the compression chamber.

3. The compressor according to claim 1, wherein the valve is moved by a spring, a fluid pressure, or a motor.

4. The compressor according to claim 1, further comprising a slide valve, wherein the compressor inlet is disposed on the slide valve, the slide valve is configured to be movable along the axial direction.

5. The compressor according to claim 1, wherein the variable injection position of the injection port is changed based on a working condition of the compressor.

6. The compressor according to claim 5, wherein the working condition is one or more of a pressure of the compressor inlet, a pressure of the compressor outlet, and a pressure difference between the compressor outlet and the compressor inlet.

7. A refrigeration circuit, comprising a compressor disposed upstream of a condenser, the condenser disposed upstream of an expansion device, the expansion device disposed upstream of an evaporator, and an economizer fluidically connected to the compressor, the compressor further including:

a bore, a rotor disposed within the bore, a shaft supporting the rotor, the shaft extending in an axial direction, a compressor inlet, a compressor outlet, a compression chamber defined between the bore and the rotor, and an injection port having a variable injection position along the axial direction, wherein the compression chamber is fluidically connected to the economizer through the injection port, the refrigeration circuit further comprising a manifold fluidically connecting the economizer and the compression chamber, the manifold further including:

a manifold inlet disposed downstream of the economizer, a plurality of manifold outlets disposed downstream of the manifold inlet, the manifold outlets disposed upstream of the compression chamber, wherein each manifold outlet is disposed at a different location along the axial direction, a valve disposed downstream of the manifold inlet and upstream of the manifold outlets, wherein the valve is configured to be movable along the axial direction such that only one manifold outlet is fluidically connected to the manifold inlet allowing the injection position to be changed.

8. The refrigeration circuit according to claim 7, wherein the economizer is configured to inject a working fluid into the compression chamber through the injection port.

9. The refrigeration circuit according to claim 7, wherein the valve is moved by one of a spring, a fluid pressure, and a motor.

10. The refrigeration circuit according to claim 7, further comprising a slide valve, wherein the compressor inlet is disposed on the slide valve, the slide valve is configured to be movable along the axial direction, the output capacity of the compressor being regulated by a movement of the slide valve such that the compressor is unloadable.

* * * * *